US008107591B2

(12) United States Patent
Freudenberger et al.

(10) Patent No.: US 8,107,591 B2
(45) Date of Patent: Jan. 31, 2012

(54) X-RAY TUBE WITH A CATCHING DEVICE FOR BACKSCATTERED ELECTRONS, AND OPERATING METHOD THEREFOR

(75) Inventors: Joerg Freudenberger, Kalchreuth (DE); Ernst Neumeier, Aurachtal (DE)

(73) Assignee: Siemens Aktiengesellschaft, München (DE)

( * ) Notice: Subject to any disclaimer, the term of this patent is extended or adjusted under 35 U.S.C. 154(b) by 88 days.

(21) Appl. No.: 12/702,476

(22) Filed: Feb. 9, 2010

(65) Prior Publication Data

US 2010/0202590 A1 Aug. 12, 2010

(30) Foreign Application Priority Data

Feb. 9, 2009 (DE) ..... 10 2009 008 046

(51) Int. Cl.
*H01J 35/18* (2006.01)

(52) U.S. Cl. ..... 378/140; 378/138

(58) Field of Classification Search ..... 378/119, 378/140, 137–138
See application file for complete search history.

(56) References Cited

U.S. PATENT DOCUMENTS

| | | | | |
|---|---|---|---|---|
| 5,995,585 | A | 11/1999 | Salasoo | |
| 7,260,181 | B2 | 8/2007 | McDonald et al. | |
| 7,359,486 | B2 | 4/2008 | Subraya et al. | |
| 2005/0002491 | A1 | 1/2005 | Lenz | |
| 2006/0050850 | A1 | 3/2006 | Andrews et al. | |
| 2007/0140432 | A1 * | 6/2007 | Subraya et al. | 378/141 |
| 2008/0112538 | A1 | 5/2008 | Rogers | |
| 2010/0046715 | A1 | 2/2010 | Freudenberger | |
| 2010/0046716 | A1 | 2/2010 | Freudenberger | |
| 2011/0038463 | A1 * | 2/2011 | Behling et al. | 378/140 |
| 2011/0142193 | A1 * | 6/2011 | Frontera et al. | 378/16 |

FOREIGN PATENT DOCUMENTS

DE 42 30 047 C1 10/1993

* cited by examiner

*Primary Examiner* — Hoon Song
(74) *Attorney, Agent, or Firm* — Schiff Hardin LLP

(57) ABSTRACT

An x-ray tube has a cathode and a anode, and a catching device that captures backscattered electrons from the anode in the operating state of the x-ray tube. The catching device minimizes unwanted energy generation by the backscattered electrons in the catching device and the anode while maintaining a high quality of the focus by the catching device being electrically insulated with respect to the anode and the cathode and being placed at an electrical potential having a value between the value of the electrical potential of the anode and the value of the electrical potential of the cathode, and the amount of the difference between the potential of the catching device and the potential of the anode is in the range from 1% to 40% of the amount of the difference between the potential of the cathode and the potential of the anode.

17 Claims, 4 Drawing Sheets

X-RAY TUBE WITH A CATCHING DEVICE FOR BACKSCATTERED ELECTRONS, AND OPERATING METHOD THEREFOR

BACKGROUND OF THE INVENTION

1. Field of the Invention

The present invention involves an x-ray tube with a cathode and an anode and with a catching device to capture backscattered electrons from the anode in the operating state of the x-ray tube. The invention further concerns a method to operate such an x-ray tube.

2. Description of the Prior Art

To generate x-rays with an x-ray tube, electrons are emitted in the operating state of the x-ray tube, which are accelerated in the direction of a positively charged anode through an electric field from a negatively charged cathode. The electrons, which strike the anode in the so-called focus, release at least part of their energy there in the form of x-rays, which reach the outside of the tube through an exit window in the housing of the tube and can be used to generate radiographs.

X-ray tubes can be designed with a single-pole structure, wherein the anode is grounded and the cathode is at a negative potential relative to. Alternatively, in a double-pole structure the housing of the x-ray tube is typically grounded and the cathode and the anode are respectively at negative potential and positive potential relative thereto.

In the operating state of the x-ray tube, some of the electrons that reach the anode rebound from the anode and are then once again accelerated in the direction of the anode by the electric field between the cathode and anode. This process is amplified in double-pole x-ray tubes, in which the anode has a positive potential relative to the grounded housing. These electrons generally do not strike the focal point and result in unwanted extra-focal radiation. Furthermore, the energy of the anode does not correspond to the energy of the desired x-ray radiation. These unwanted effects reduce the quality of the produced x-rays, which, in turn, has a negative effect on the image quality of an x-ray image that is gained with this type of radiation.

To avoid this negative effect, a catching device can be inserted in the x-ray tube between the cathode and anode, which absorbs the electrons that are backscattered by the anode, so as to prevent those electrons from again being accelerated in the direction of the anode.

Catching devices are known that capture backscattered electrons from the anode and that are designed in the form of a shaft or as a specially-formed center part between the cathode and anode. Thermal energy is mainly absorbed through the impact of electrons in these components which are often referred to as backscattered electron acceptors (BSE-catchers). To discharge the resulting heat in an appropriate way, suitable material with thermal conductivity must be used for these components. Backscattered electrons that do not reach the backscattered electron acceptor impact the anode again and consequently raise the temperature of the anode additionally. Thereby the anode generates unwanted extra-focal radiation.

SUMMARY OF THE INVENTION

An object of the invention is to provide an optimized catching device that minimizes to the extent possible the unwanted introduction of energy by the backscattered electrons into the catching device and the anode. The invention also concerns a corresponding operating method to ensure high quality of the focus.

This object is achieved in an x-ray tube wherein the catching device is electrically insulated with respect to the anode and the cathode and by being placed at an electrical potential having a value between the value of the electrical potential of the anode and the value of the electrical potential of the cathode, and wherein the amount of the difference between the potential of the catching device and the potential of the anode is in the range from 1% to 40% of the value of the difference between the potential of the cathode and the potential of the anode, preferably a value in the range from 20% to 40%.

The invention is based on the thought that the backscattered electrons should be slowed to avoid or reduce the deposition of thermal energy in the catching device and the anode, thereby losing kinetic energy.

At the same time, the quality of the x-rays can be improved through negative acceleration, that is to say the slowing down of the electrons. Slowed down electrons that do not reach the catching device, are again accelerated in the direction of the anode. However, if the energy of the electrons with renewed impact on the anode is low enough, the electromagnetic radiation generated from the electrons, at best, does not contribute the x-rays and is absorbed in the exit window.

The slowing down of the backscattered electrons can be achieved by placing the catching device at an electrical potential that is between the electrical potential of the cathode and the electrical potential of the anode. For this purpose, the catching device must be insulated with respect to the surrounding components.

The aforementioned range for the potential of the catching device is a result of the following consideration: The energy that an electron achieves during acceleration in a potential gradient is the product of the electron charge and the potential gradient. Backscattered electrons achieve the maximal energy of 60 keV at a potential difference of approximately 60 kV between the catching device and the anode. However, photons with such maximal energy are essentially absorbed in the exit window of the x-ray tube. In a typical potential difference in double-pole x-ray tubes of essentially 150 kV, 60 kV corresponds to 40% of this difference. Even lower photon energy can be achieved by the use of higher potentials of the catching device.

The potential difference between the catching device and the anode can result in a further advantageous effect. With a suitable shape of the catching device, the electrical field in the space between the catching device and the anode can act as an electrostatic lens for the electron beam. The components of the lines of force can be maintained perpendicularly to the direction of the electron beam through the catching device and the anode of the adjacent potential and the thereby-defined constraints for the electrical field. These electrons that have deviated from the optimal trajectory again proceed in the direction of the center of the focus. The effect of the increased space charge can thus be reduced. This is especially important since the time-of-flight of the electron is generally longer through the use of a catching device than with the use of x-ray tubes without such a component.

Advantageously, the x-ray tube is surrounded by a grounded housing. The catching device is preferably electrically insulated with respect to the housing since the catching device in the present invention is placed at an electrical potential, which has a value that is specified dependent on the potential difference between the cathode and the anode.

In a preferred embodiment, the x-ray tube is designed as a double-pole tube. Both the anode as well as the cathode is electrically insulated with respect to the grounded housing. The anode and the cathode are thereby placed at potentials that are essentially the same magnitude, but differ in sign. In this type of x-ray tube, it is especially advantageous for the cathode to be placed at a potential of essentially −75 kV and the anode to be placed at a potential of essentially +75 kV, both potentials being referenced to the potential of the housing. The catching device is then preferably placed at a potential with a value between 20 and 40 kV in relation to the potential of the housing.

The maximum energy that the backscattered electrons from the anode can reach upon their second impact on the anode is determined by the electrical potential of the catching device. By a suitable choice of this potential, the electromagnetic radiation of these electrons will be in such an energy range that the electromagnetic radiation is absorbed by the exit window in the housing of the x-ray tube. Therefore the electromagnetic radiation does not contribute to the emission of x-rays and the quality of the x-rays is not impaired.

The electrons that are captured by the catching device generate thermal energy in the catching device, increasing the temperature of the catching device. This heat should be discharged by suitable measures. Therefore, cooling channels are embedded in the catching device. In the operating state of the tube, a coolant liquid is circulated through these cooling channels. In addition, supplies and drains for the coolant are connected with the cooling channels.

To ensure electrical insulation of the catching device with respect to the anode, cathode and the housing, the supplies and drains advantageously have electrically insulated sections. These are preferably designed as tubular ceramic insulators.

The catching device should be able to fulfill different purposes. As described, it should be placed at a well-defined electrical potential and should be insulated from the surroundings. Furthermore, it is the purpose of the catching device to stop the infiltrating electrons. The resulting heat should be discharged. These requirements can be sufficiently performed by a catching device composed of multiple layers, each of which have different characteristics and each of which is formed of a different material. Preferably, the layer facing the cathode is thicker than the other layer or layers and can be considered to form the base material of the catching device.

The catching device should be electrically insulated with respect to the cathode, the anode and preferably the housing. The electrical insulation of the catching device can be achieved by an electrical insulated layer; advantageously Al2O3 and/or SiC can be used as materials.

The outermost surface layer facing the anode is designed to stop the backscattered electrons. A further requirement or constraint is that this surface layer must be electrically conductive so that it forms an equipotential surface to which the specific electrical potential can be applied. In addition, electrically conductible materials should be used, especially metals or conductive ceramics with an atomic number less than or equal to 14. For example, Al, Be, C, LP:SiC, Si—SiC are suitable for this purpose. Furthermore, the surface layer advantageously has a thickness of between 10 and 300 μm.

In order to discharge the generated (introduced) thermal energy, the catching device advantageously has a layer with a high thermal conductivity, which, for example, can receive one or more of the materials Cu, CuODS, or SiC. To an extent, this layer can be viewed as the base material of the catching device and is preferably located on the side facing the cathode.

Concerning the method, the above-mentioned object is achieved according to the invention, by placing the catching device at an electrical potential having a value between the value of the electrical potential of the anode and the value of the electrical potential of the cathode, with the magnitude of the difference between the potential of the catching device and the potential of the anode being in the range from 1% to 40% of the magnitude of the difference between the potential of the cathode and the potential of the anode.

That means that the potential of the catching device is set so that the backscattered electrons will not contribute to emission of x-rays upon renewed impact on the anode and the following photon emission. Additionally, the generation (introduction) of heat in the catching device and the anode can be distributed in an optimized way and can be kept as low as possible.

An advantage achieved with the invention is that impairment of the x-ray by extra-focal radiation can be largely avoided by intentionally modified impact from the backscattered electron acceptor of the x-ray tube, at electrical potential with a value suitably chosen in relation to the potential of the anode and the cathode.

During the operating state of the x-ray tube, the electrons introduce energy both in the anode as well as in the catching device, and possibly in other components. It is a further advantage of the invention that the catching device can influence the portions of the energy generated in the catching device by a suitable chosen value of the electrical potential. The portion of the total energy that is deposited in the catching device and the portion of the total energy that is deposited in the anode can be ideally configured. Ideally, all components should absorb an amount of energy that is as low as possible.

It is a further advantage that the number of electrons that are stopped in the catching device is increased by the slowing down of the electrons. It is likely that at high energy, the electrons in the scattering process emit only a part of their energy and then exit the catching device again. However this effect is small—for a potential difference of 20% to 40% between the catching device and the anode, approximately between 0.5% and 1% more energy is released in the catching device.

By applying a suitably chosen potential at the catching device, from the energy as a whole used to generate ex-rays, the portion that is converted in heat in the catching device or the anode is kept as low as possible. Therefore energy is saved in the process of generating x-rays. Also the load of the surface of the catching device is kept as low as possible. Thus the operating life of this component can be increased. Alternatively, the catching device can thus be built as a compact unit.

DESCRIPTION OF THE PREFERRED EMBODIMENTS

Figure 1:
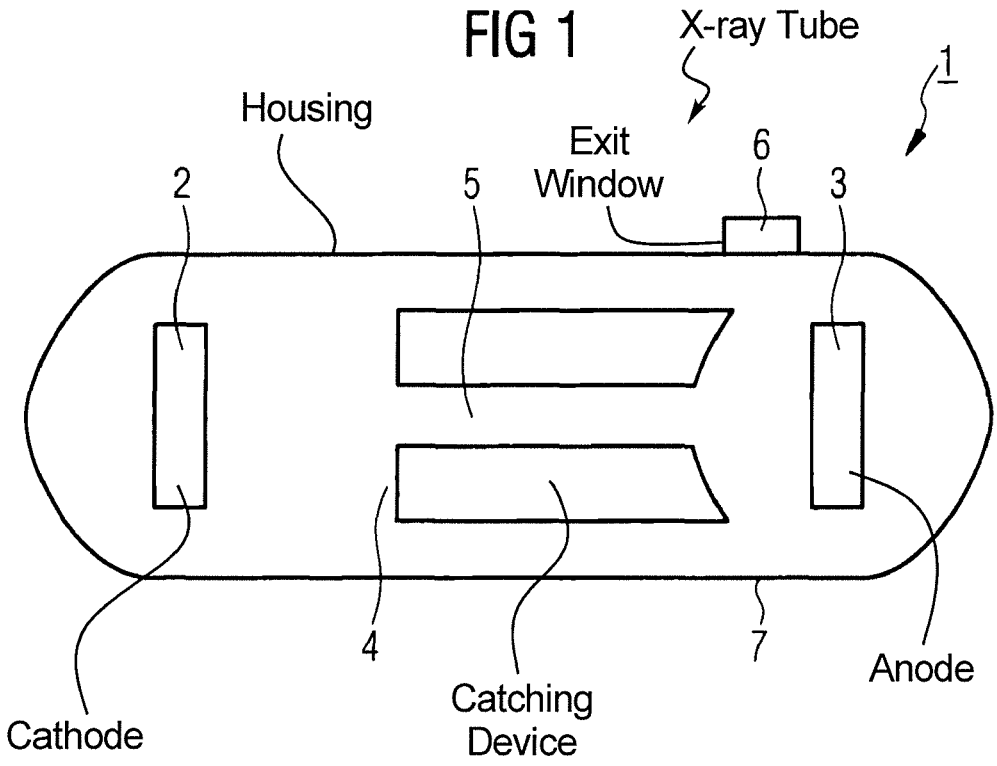
FIG. 1 is a section through a preferred embodiment an x-ray tube in accordance with the invention, having a cathode, an anode and a catching device, which is surrounded by a housing with an exit window for x-rays.

The x-ray tube 1, according to FIG. 1 has a cathode 2, an anode 3 and a catching device 4. In the operating state, the electrons that are emitted from the cathode 2 are accelerated through an electrical field in the direction of the anode 3. The electron beam path proceeds through a corridor 5 in the catching device 4 to the anode 3. When the electrons impact the anode 3 they generate x-rays, which reach the outside through an exit window 6 embedded in the housing 7 of the x-ray tube. When some of the electrons are steered back in the direction of the cathode 2, secondary processes take place. Depending on their energy, these electrons are either stopped in the catching device 4 or, if they do not reach the catching device 4, they are again accelerated in the direction of the anode 3 and there generate secondary radiation upon impact.

The catching device 4 is placed on an electric potential that causes the electrons that are backscattered from the anode 3 to be slowed down and thereby lose kinetic energy. With a suitably chosen potential, namely when the potential difference between the catching device 4 and the anode 3 is in a range from 1% to 40% of the potential difference between the cathode 2 and the anode 3, the backscattered electrons that do not reach the catching device 4 exhibit a maximum photon energy that allows the emitted radiation to be partially or completely absorbed in the exit window 6 upon repeated impact on the anode 3.

Figure 2:
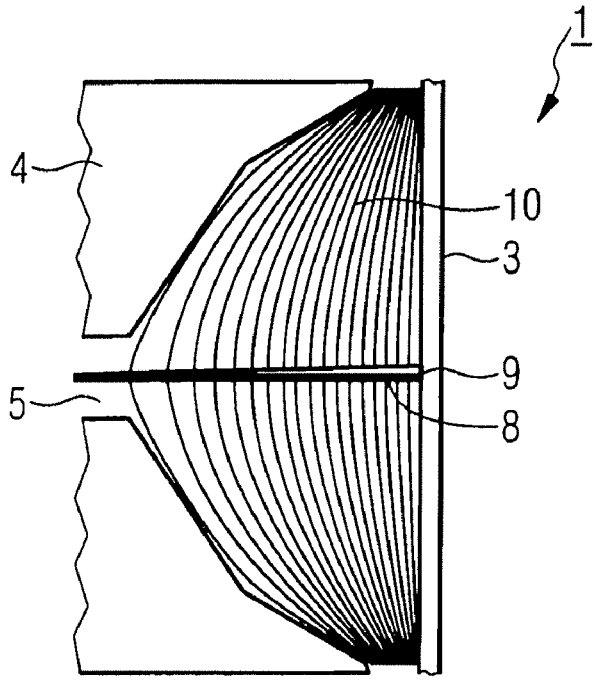
FIG. 2 is a detailed section through a part of the x-ray tube of FIG. 1 in the area of the catching device and the anode, where an electrical potential is applied to the catching device and the anode.

FIG. 2 shows an excerpt from the x-ray tube 1 that surrounds the anode 3 and the part of the catching device facing the anode. An electron beam 8 emerges from the cathode 2 (not shown) through the corridor 5 and strikes the anode in the focus 9. The electrical potentials at the anode 3 and the catching device 4 define constraints for the electrical potential in the area between the catching device 4 and the anode 3. The equipotential surface 10 of the electrical potential runs in immediate proximity of the anode 3, parallel to the anode surface and in immediate proximity of the catching device 4, parallel to its outer surface. Since the gradient of the electrical field, which indicates the direction of the strongest change of the potential, is perpendicular to the equipotential surface 10, it aligned close to the beam axis in the direction of the center of the beam. The electrical potential between the catching device 4 and the anode 3 thereby acts as an electrostatic lens that focuses the electrons in the direction of the center of the beam. Thus the effect of the space-charge amplification is reduced, which is created when electrons repel each other during their flight from the cathode 2 to the anode 3 because of the repulsive Coulomb force acting between them, which increases their spatial distance between each other.

Figure 3:
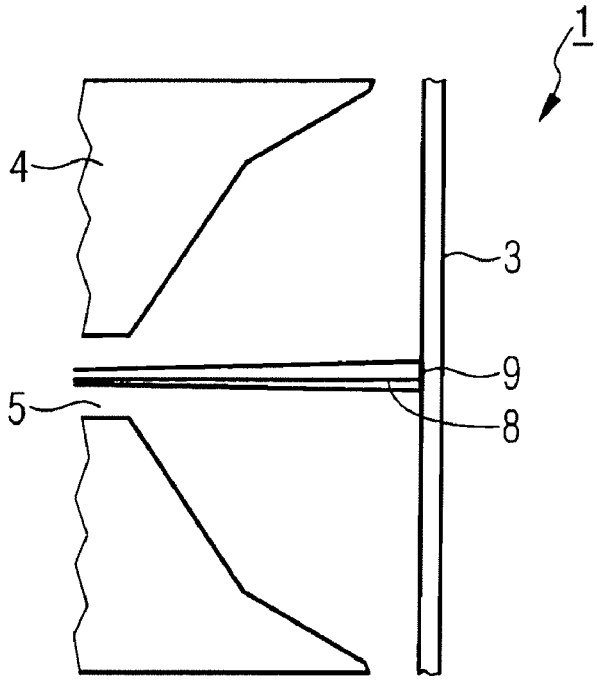
FIG. 3 is a section of FIG. 3 in which no potential is applied to the catching device.

For comparison, FIG. 3 shows an identical structural and geometrical catching device 4, which is not at a potential with the aforementioned value. The electrons emitted from the cathode 2 (not shown) propagate through the corridor 5 and strike the anode 3 in the focus 9. Since there is no field that acts as an electrostatic lens between the catching device 4 and the anode 3, the effect of the space-charge amplification, in this case is greater than when the potential is next to the above-mentioned value, which results in a larger focus 9 on the anode 3.

Figure 4:
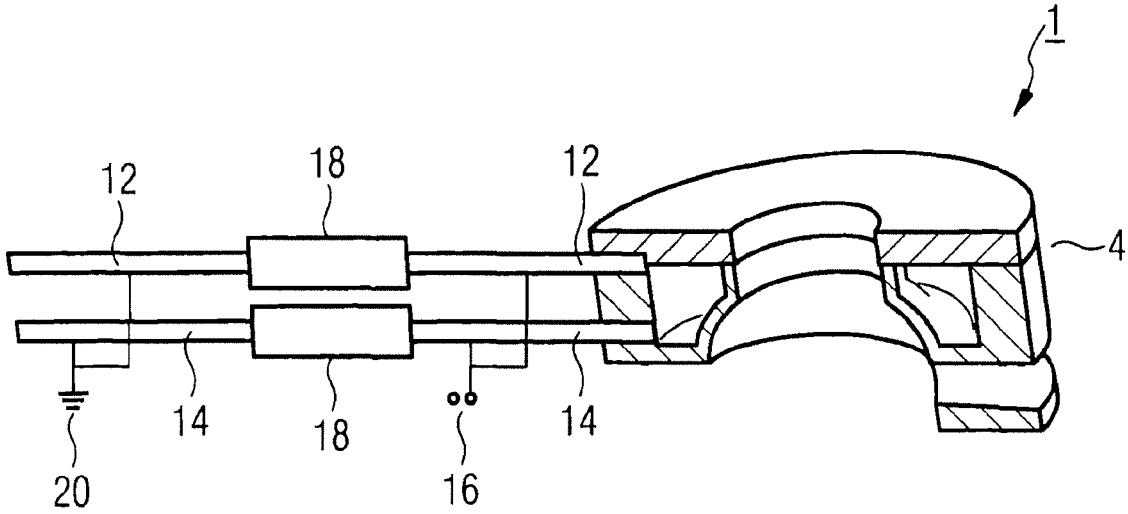
FIG. 4 shows the catching device of the x-ray tube in a perspective view with supplies and drains for the coolant and ceramic insulators.

According to FIG. 4, cooling channels (not shown) can be embedded in the catching device 4 in order to divert the heat resulting from the electron bombardment in the catching device 4. These are connected with a coolant circuit (not shown) through a supply 12 and a drain 14. A voltage can be applied to the supply 12 and the drain 14 through a voltage source 16 to thereby charge the catching device 4 or the surface facing the anode 3 with the desired electrical potential. Tubular ceramic insulators 18 are inserted in the supply 12 and drain 14 which ensure an electrical insulation of the catching device 4 toward a ground potential 20.

Figure 5:
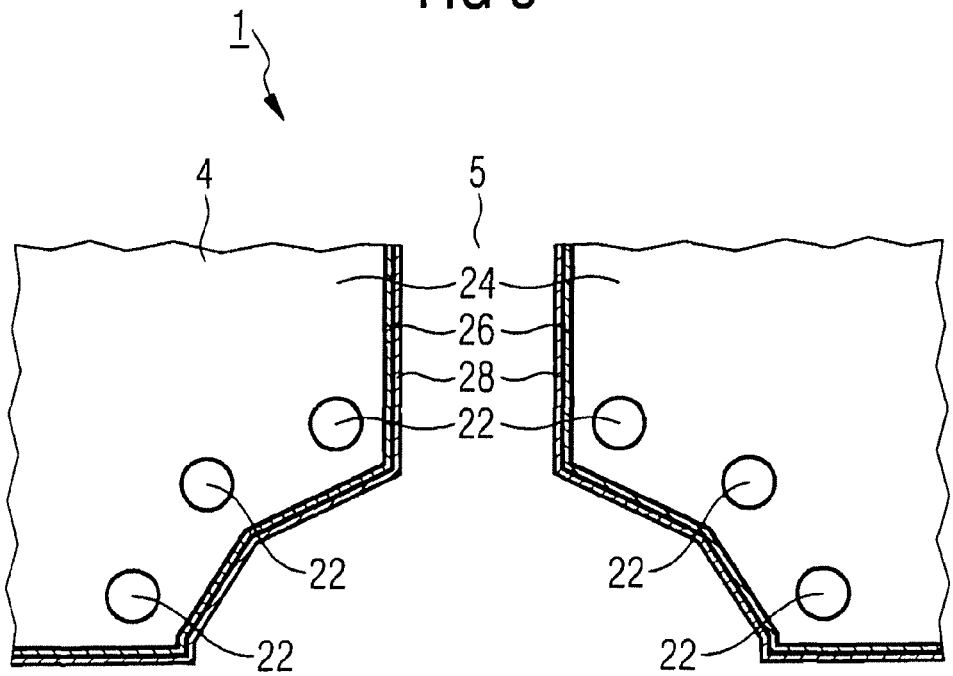
FIG. 5 is a section through the catching device according to FIG. 4.

FIG. 5 shows a section through the catching device 4. The cathode 2 (not shown) of the x-ray tube 1 is on this occasion positioned above the figure on the level of the sheet, while the anode 3 (not shown) is positioned at the lower part of FIG. 5 on the level of the sheet. Cooling channels 22 are embedded in the catching device 4 through which coolant is flowing in the operating state. Thus the heat resulting in the catching device 4 can be diverted. According to experience, the catching device must be able to absorb and divert an amount of approximately 0.4*(1−(0.01 to 0.4)) of incident energy primarily on the anode. This is therefore approximately 24 to 39.6% of the incident energy. In an x-ray emitter with 100 kW power, this is thus 24 to 39.6 kW of thermal power output that needs to be discharged.

The catching device 4 is built of several layers, which fulfill different functions.

A heat conductive layer 24 facing the cathode is designed to divert heat as best as possible and is virtually the basis material which forms the catching device. It is therefore composed of materials with good thermal conductivity, especially Cu, CuODS, or SiC. The cooling channels 22 are embedded in this layer 24 to divert the deposited heat in the catching device 4.

An insulation layer 26 connected with the heat-conductive layer 24 ensures the electrical insulation of the surface layer 28 (described below) with respect to the housing 7, the cathode 2, the anode 3 (each not shown), and optionally other components of the x-ray tube 1. For this purpose the insulation layer 26 is advantageously built of Al2O3 and/or SiC.

A surface layer 28 facing the anode is electrically conductive and designed to stop the backscattered electrons from the anode 3. Through its conductivity, the surface layer 28 allows for an electrical potential to be applied. The surface layer 28 preferably has a thickness of between 100 to 300 μm. Advantageously, electrically conducting metals or conductive ceramics are used for its production, especially suitable for this purpose are the materials Al, Be, C, LP:Sic, SiSiC.

Figure 6:
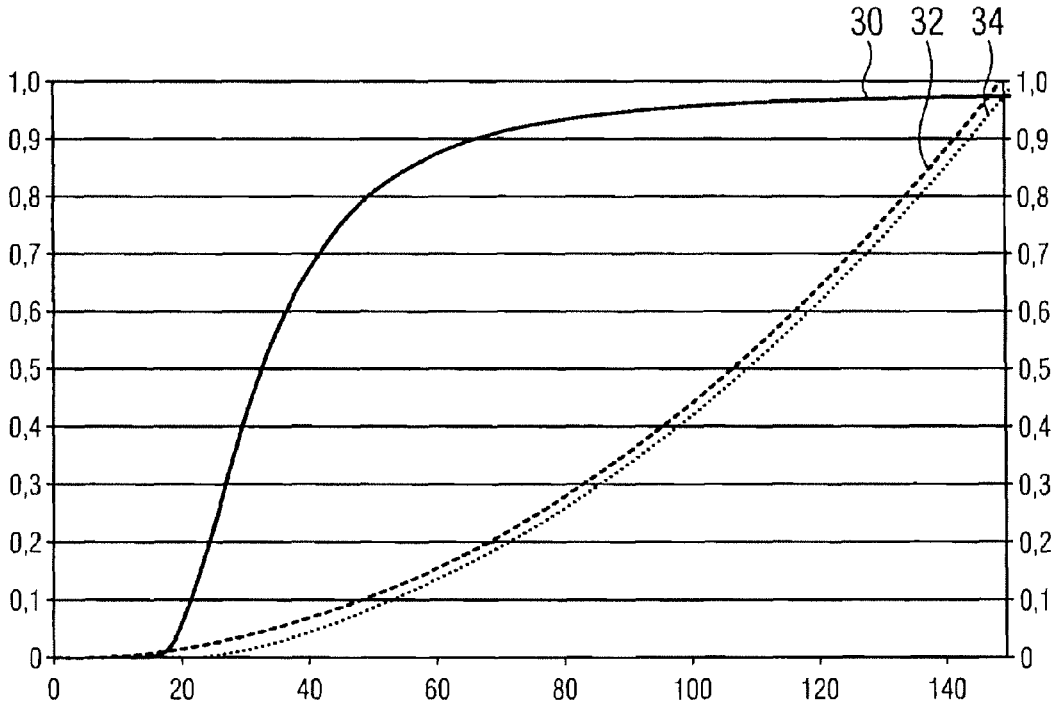
FIG. 6 is a graph showing the transmission of x-rays through titanium as the function of the primary electron energy.

By the application of a potential, the catching device 4 allows the electrons backscattered from the anode 3 to slow down. Backscattered, slowed down electrons do not reach the catching device 4, and have a certain maximum energy through a suitable choice of the potential, so that photons with this or a lower energy will be absorbed in the exit window 6 of the x-ray tube. Such an exit window 6 is formed of, for example, 0.4 mm thick titanium. The transmission 30 of photons through such a window as a function of its energy is represented in FIG. 6. On the abscissae the energy is represented in a unit of keV, the transmission is represented on the left-side ordinate (unitless). The value 1 thereby signifies complete transmission, while the value 0 characterizes complete absorption of the photons in the exit window. Photons with energy up to approximately 20 keV are almost completely absorbed in the titanium material used. The transmission 30 only increases strongly with larger photon energies before it reaches energies greater than 60 keV at saturation close to the value 1. Consequently, in this specific case, the potential at the catching device should be set to such a value that the backscattered electrons that are not stopped in the catching device 4 are given a maximum energy of 20 keV. The potential according to the invention reaches this condition of up to 50 kV for the potential differences between the anode and the cathode.

The right-side ordinate of FIG. 6 indicates the relative intensity of the generated electromagnetic radiation as a function of the photon energy. A higher relative intensity means that a photon possesses a higher share of the intensity of the electromagnetic radiation. Thus there are also different photons with different energies that are compared with each other. The relative intensity is thereby scaled with the square of the voltage and passes thereby in parabolic fashion as a function of the photo energy. FIG. 6 shows the relative intensity of the radiation 32 generated by the backscattered electrons and the relative intensity of the radiation generated by the backscattered electrons and additionally through the radiation 34 transmitting titanium window. Due to the squared relation of the relative intensity to the photon energy, the relative intensity is very low at low energies, for example, up to 20 keV of the radiation generated by the backscattered electrons. Also photons up to approximately 50 keV only contribute marginally to the transmission radiation through the exit window with a relative intensity of 10%.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

an evacuated housing;

a cathode and an anode in said evacuated housing, said cathode emitting electrons that are accelerated in a propagation path to said anode and strike said anode, causing emission of x-rays from said anode as well as backscattered electrons;

a catching device in said housing in said propagation path between said cathode and said anode, said catching device capturing said backscattered electrons from said anode, and being electrically insulated with respect to the anode and with respect to the cathode; and a voltage source arrangement that establishes electrical potentials at said anode, said cathode and said catching device, said voltage source arrangement placing said catching device at an electrical potential having a value between a value of electrical potential at said anode and a value of electrical potential at said cathode, with a magnitude of a difference between the electrical potential of the catching device and the electrical potential of the anode being in a range between 1% and 40% of a magnitude of a difference between the electrical potential of a cathode and the electrical potential of the anode.

2. An x-ray tube as claimed in claim 1 wherein said housing is grounded, and wherein said catching device is electrically insulated with respect to said housing.

3. An x-ray tube as claimed in claim 2 wherein said anode and said cathode are electrically insulated with respect to said housing, forming a double-pole arrangement, and wherein said cathode is at an electrical potential of substantially −75 kV and said anode is at an electrical potential of substantially +75 kV, and wherein said catching device is an electrical potential relative to said housing having a magnitude between 20 and 40 kV.

4. An x-ray tube as claimed in claim 2 wherein said housing has an exit window therein through which said x-rays exit said housing, and wherein said catching device is at an electrical potential that causes electrons backscattered from said anode and again accelerated toward said anode so as to again strike said anode, to be substantially completely absorbed at said exit window.

5. An x-ray tube as claimed in claim 1 wherein said catching device comprises cooling channels therein connected to a coolant source that circulates coolant through said channels.

6. An x-ray tube as claimed in claim 5 wherein said catching comprises a coolant intake and a coolant discharge that connects said coolant channels to said coolant source, said coolant intake and said coolant discharge each comprising an electrically isolated section.

7. An x-ray tube as claimed in claim 6 wherein each of said electrically isolated sections is formed by a tubular ceramic insulator.

8. An x-ray tube as claimed in claim 1 wherein said catching device comprises a plurality of layers.

9. An x-ray tube as claimed in claim 8 wherein one of said layers of said catching device is an electrically insulated layer.

10. An x-ray tube as claimed in claim 9 wherein said electrically insulated layer contains material selected from the group consisting of $Al_2O_3$ and SiC.

11. An x-ray tube as claimed in claim 8 wherein one of said plurality of layers of said catching device is a surface layer that faces said anode, said surface layer being comprises of electrically conducting material.

12. An x-ray tube as claimed in claim 11 wherein said electrically conducting material is selected from the group consisting of ceramics and metals having anatomic number less than or equal to 14.

13. An x-ray tube as claimed in claim 11 wherein said electrically conducting material is selected from the group consisting of Al, Be, C, LP:SiC, SiSiC.

14. An x-ray tube as claimed in claim 11 wherein said surface layer has a thickness between 10 and 300 μm.

15. An x-ray tube as claimed in claim 8 wherein one of said plurality of layers of said catching device is a layer comprised of material having a high thermal conductivity.

16. An x-ray tube as claimed in claim 15 wherein said material having a high thermal conductivity is selected from the group consisting of Cu, CuODS, and SiC.

17. A method for operating an x-ray tube having a cathode and an anode in an evacuated housing, said cathode emitting electrons that are accelerated in a propagation path to said anode and strike said anode, causing emission of x-rays from said anode as well as backscattered electrons, comprising the steps of:

locating a catching device in said housing in said propagation path between said cathode and said anode and, with said catching device, capturing said backscattered electrons from said anode, and electrically insulating said catching device with respect to the anode and with respect to the cathode; and establishing electrical potentials at said anode, said cathode and said catching device to place said catching device at an electrical potential having a value between a value of electrical potential at said anode and a value of electrical potential at said cathode, and to produce a magnitude of a difference between the electrical potential of the catching device and the electrical potential of the anode in a range between 1% and 40% of a magnitude of a difference between the electrical potential of a cathode and the electrical potential of the anode.

* * * * *